United States Patent [19]

Lemke

[11] Patent Number: 4,887,977

[45] Date of Patent: Dec. 19, 1989

[54] CABLE CONNECTOR HAING A RESILIENT COVER

[75] Inventor: Timothy A. Lemke, Carlisle, Pa.

[73] Assignee: E. I. DuPont De Nemours and Company, Wilmington, Del.

[21] Appl. No.: 209,486

[22] Filed: Jun. 15, 1988

[51] Int. Cl.[4] ..... H01R 9/07

[52] U.S. Cl. ..... 439/497; 439/465

[58] Field of Search ..... 439/493, 497, 499, 465, 439/468

[56] References Cited

U.S. PATENT DOCUMENTS

| | | | |
|---|---|---|---|
| RE. 27,463 | 8/1972 | Sitzler et al. | 339/59 R |
| 3,696,319 | 10/1972 | Olsson | 339/17 F |
| 3,701,071 | 10/1972 | Landman | 339/4 |
| 3,820,058 | 6/1974 | Friend | 339/99 R |
| 3,934,075 | 1/1976 | Dilliplane | 174/75 R |
| 4,005,921 | 2/1977 | Hadden et al. | 339/22 B |
| 4,109,991 | 8/1978 | Evans | 339/99 R |
| 4,169,641 | 10/1979 | Olsson | 439/493 |
| 4,248,491 | 3/1981 | Mouissie | 339/17 F |
| 4,252,389 | 2/1981 | Olsson | 339/17 |
| 4,252,392 | 2/1981 | Whiteman, Jr. | 339/74 R |
| 4,406,512 | 9/1983 | Schell | 339/177 R |
| 4,416,501 | 11/1983 | Fusselman et al. | 339/97 R |
| 4,441,779 | 4/1984 | Foederer et al. | 339/99 R |
| 4,508,415 | 4/1985 | Bunnell | 439/497 |
| 4,601,530 | 7/1986 | Coldren et al. | 339/103 M |
| 4,605,276 | 8/1986 | Hasircoglu | 339/176 MF |
| 4,606,596 | 8/1986 | Whiting et al. | 339/107 |
| 4,616,415 | 10/1986 | Doutrich et al. | 29/857 |
| 4,618,202 | 10/1986 | Libregts et al. | 339/99 R |
| 4,629,271 | 12/1986 | Awano | 339/75 MP |
| 4,636,023 | 1/1987 | Olsson | 339/103 |
| 4,641,902 | 2/1987 | Fusselman | 339/91 R |
| 4,684,183 | 8/1987 | Kinoshita et al. | 439/77 |
| 4,697,339 | 10/1987 | Verhoeven | 29/828 |
| 4,701,001 | 10/1987 | Verhoeven | 439/394 |
| 4,715,824 | 12/1987 | Verhoeven | 439/391 |
| 4,723,916 | 2/1988 | Fusselman et al. | 439/92 |
| 4,731,031 | 3/1988 | Lemke | 439/76 |
| 4,735,582 | 4/1988 | Fusselman et al. | 439/329 |

OTHER PUBLICATIONS

U.S. Statutory Invention Registration, No. H379, Dec. 1, 1987, Alexander, Jr.

Wire Products 2000 Bulletin Brochure, Sep. 1980, Berg/Serpent Connector, pp. 4 and 5.

*Primary Examiner*—Eugene F. Desmond

[57] ABSTRACT

A cable connector for a flat cable is characterized by a base and a cover which, when conjoined, define a cable receiving volume therebetween. The cover is provided with a resilient flap which, when deformed by a cable received in the cable receiving volume, reacts to generate a clamping force serving to strain relieve the cable with respect to the connector.

8 Claims, 4 Drawing Sheets

CABLE CONNECTOR HAING A RESILIENT COVER

BACKGROUND OF THE INVENTION

1. Field of the Invention

The present invention relates to a connector for a flat cable and, in particular, to such a connector in which the strain relief for the cable is provided by a cover having a resilient flap thereon.

2. Description of the Prior Art

Flat cables are usually terminated by introducing the end thereof into the housing of a cable connector. Within the cable connector the individual conductors of the cable are joined to appropriate contact elements mounted within the housing. The housing is typically formed of conjoined upper and lower housing sections which when mated define a cable receiving volume therewithin. Provision must be made for strain relief of the end of the cable so that forces imposed on the cable will not result in separation of the conductors from the contacts. Typical of such a structure is that shown in U.S. Pat. No. 4,618,202 (Libregts et al.), assigned to the assignee of the present invention.

Several alternative arrangements for providing the necessary strain relief to the cable are known. For example a strain relief bar may be secured within the housing of the connector transversely of the axes of the conductors therein. The bar is secured to one of the housing sections, as by screws. Alternatively, each of the housing sections may be provided with a confronting flange which cooperate to define a window opening from the rear surface of the connector housing. The flanges may be separated, if desired. As the upper and lower housing sections are joined together, as by the use of screws, the flanges compress the cable to provide the necessary strain relief.

There is also known a strain relief arrangement which uses an elastomeric strain relief pad mounted to a metallic support bar. Such an arrangement is used in a connection manufactured and sold by the Interconnect and Packaging Group of E. I. du Pont de Nemours and Company, Inc. as the Berg/Serpent Connector. Other systems, such as disclosed in U.S. Pat. Nos. 4,601,530 (Coldren et al) and 4,636,023 (Olsson), utilize tools to drive strain relief members into engagement with the cable.

Each of these alternatives is believed to have disadvantages associated therewith. The number of steps required to fabricate the transversely extending strain relief bar are believed to render that expedient disadvantageous. Using the confronting flanges on the housing sections to provide the strain relief results in a structure that is applicable to flat cables having only a height or thickness dimension within a predetermined range of a given height dimension. Cables having greater or lesser thicknesses cannot be advantageously strain relieved using such a system. Accordingly, connector users are required to correctly identify which one of a number of possible combinations of housing sections are to be used in providing strain relief for the particular flat cable under consideration. Also, variations in thickness of the cable across its transverse dimensions may result in localized portions of the cable not having an effective strain relief. The provision of an elastomeric strain relief pad on a metallic bar is relatively expensive owing to the operations that must be performed in fabricating the bar and to the relatively limited range of thicknesses able to be accommodated.

In view of the foregoing it is believed advantageous to provide a connector housing having a strain relief arrangement that is adaptable for use with a flat cable having a thickness lying within a relatively wide range of thicknesses. Moreover, it is believed advantageous to provide a strain relief arrangement which is forgiving to thickness variations across the transverse dimension of the cable.

SUMMARY OF THE INVENTION

The present invention relates to a connector for a flat cable having a connector housing formed of a lower housing section, or base, and a removable cover section. The base housing section includes a generally planar floor having upstanding sidewalls. The removable cover section is a generally planar member having a forward and a trailing edge thereon. The cover section is removeably joinable to the base and, when so conjoined, cooperates to enclose a cable receiving volume therebetween. The portion of the cover immediately adjacent to the trailing edge defines a flap, preferably slotted to define a plurality of resilient fingers which bend along a predetermined bend line toward the base. In the preferred instance plural resilient fingers extend in a generally side by side relationship across the transverse dimension of the cover and are bent or curved into the cable receiving volume such that the ends of the fingers lie therewithin.

When the cover of the connector housing is secured to the base and a planar cable introduced into the cable receiving volume the insulating jacket of the cable deflects the resilient fingers to impose a clamping force on the jacket which serves to strain relieve the cable. The resiliency of the fingers permits the connector housing to accommodate flat cables having a thickness over a relatively wide range of thickness dimensions. Moreover, when plural fingers are provided transversely of the cover variations in thickness across the transverse dimension of the cable are accommodated.

The base also includes a contact block disposed within the cable receiving volume. The block has an axial groove disposed therein. The groove is intersected at each lateral end of the block by a trough. Each trough is sized to accept a drain wire carried within the cable. The cover has a downturned hood adjacent the forward edge thereof. The hood is provided with a cutout at locations corresponding to the locations of the troughs on the contact block. The cutouts are generally similar in form to the tines of an insulation displacement contact. When the cover is affixed to the lower housing section the hood is received within the groove, and the material of the hood adjacent the cutout portions contact the drain wires lying in the troughs.

BRIEF DESCRIPTION OF THE DRAWINGS

The invention will be more fully understood from the following detailed description thereof taken in connection with the accompanying drawings which form a part of this application and in which.

Figure 2:
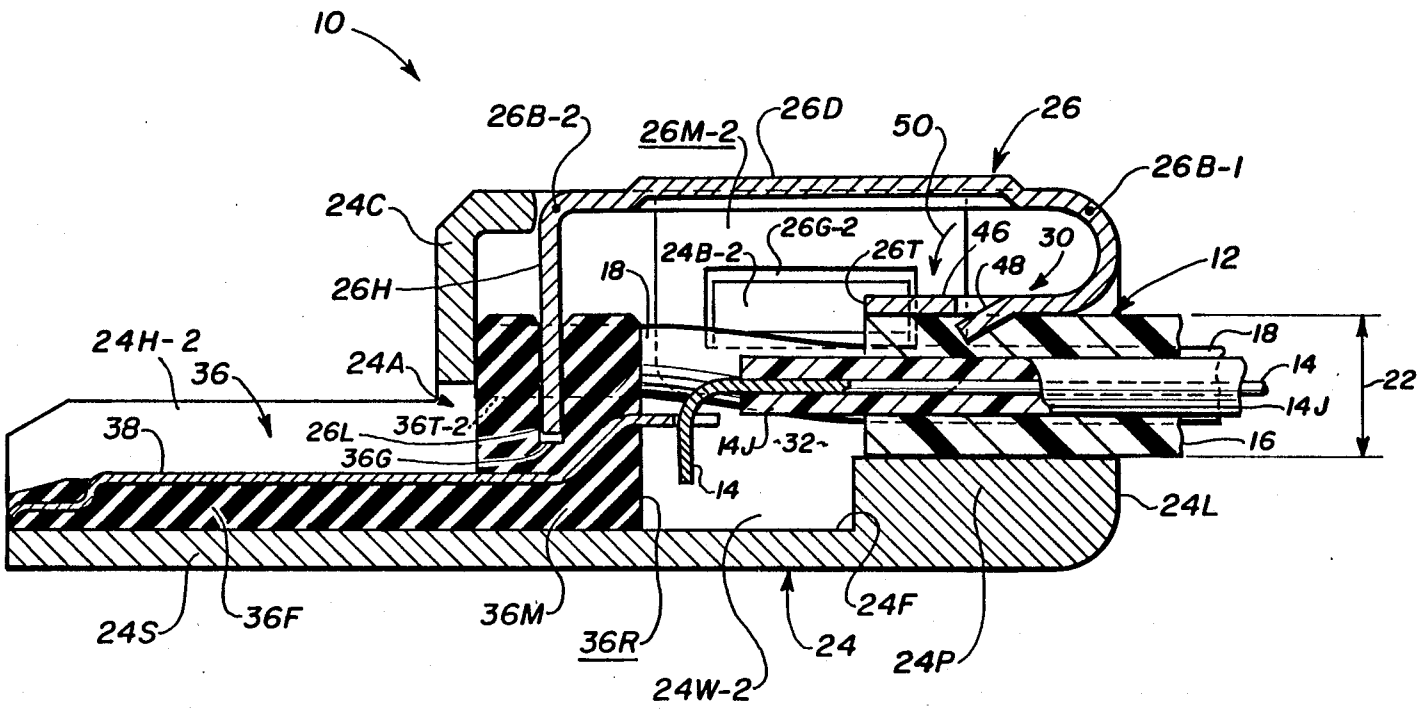
FIG. 2 is a side sectional view of the connector of FIG. 1 taken along section lines 2—2 of FIG. 1.
Figure 3:
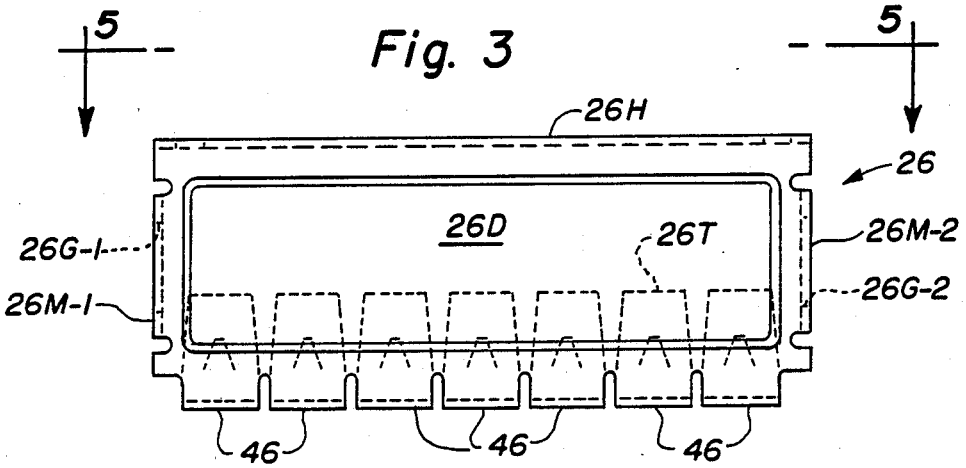
FIGS. 3 and 4 are, respectively, a plan and a front elevational view of the cover of the connector of FIGS.
Figure 4:
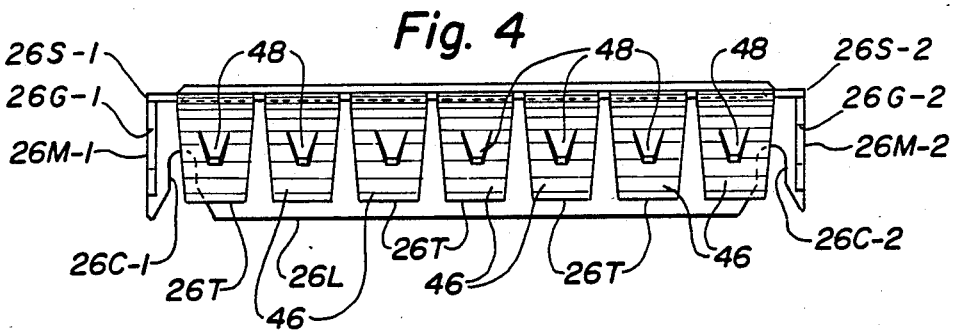
Figure 5:
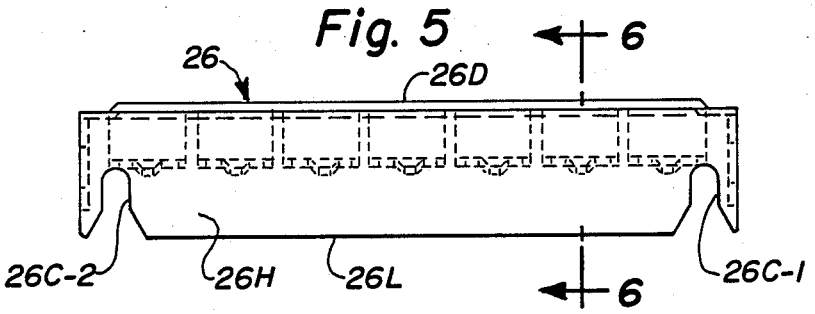
Figure 6:
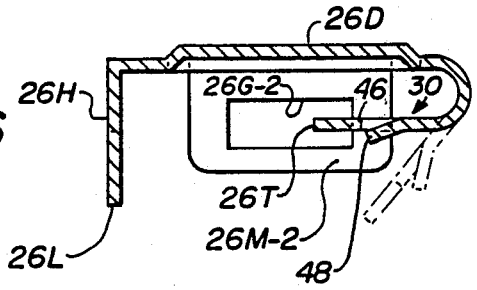
Figure 8:
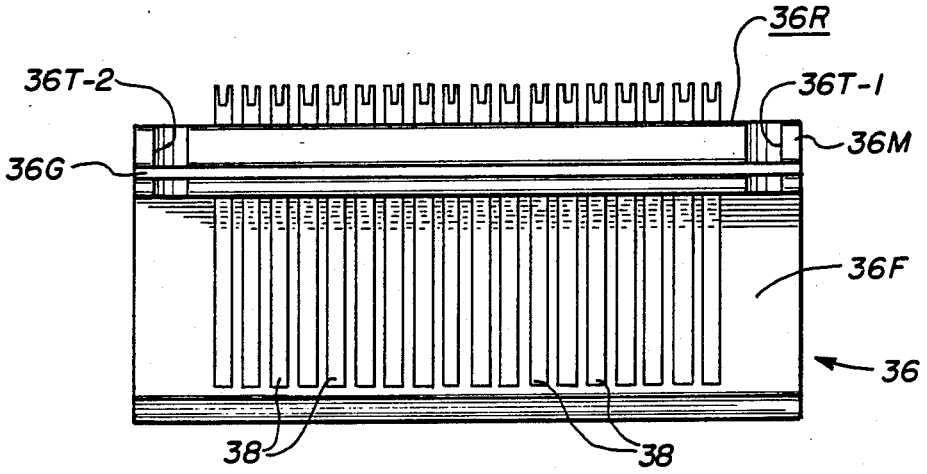
Figure 9:
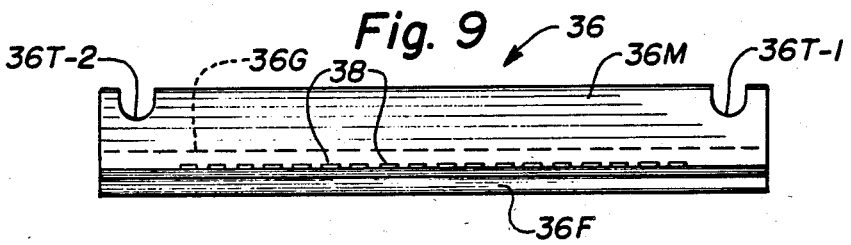
Figure 7:
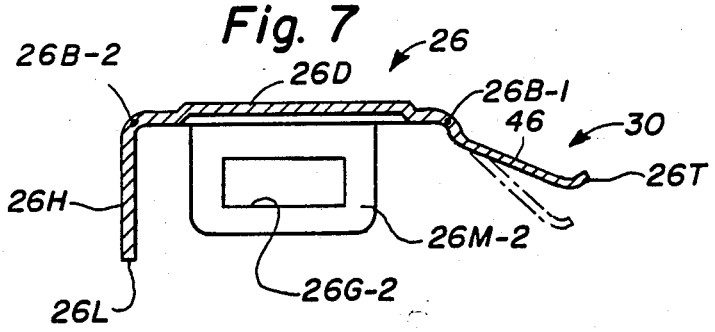

1 and 2, with the resilient fingers of the strain relief arrangement being shown in FIG. 4 in the undeflected position;

FIG. 5 is a rear elevational view of the cover of FIG. 3 taken along view lines 5—5 in FIG. 2 with the resilient fingers being shown in the deflected position;

FIG. 6 is a side elevational view taken along section lines 6—6 in FIG. 5;

FIG. 7 is a sectional view similar to FIG. 6 showing an alternate configuration of the cover in accordance with the present invention; and FIGS. 8 and 9 are, respectively, a plan and a front elevational view of a contact block used in accordance with the present invention.

DETAILED DESCRIPTION OF THE INVENTION

Throughout the following detailed descriptions similar reference numerals refer to similar elements in all figures of the drawings.

Figure 1:
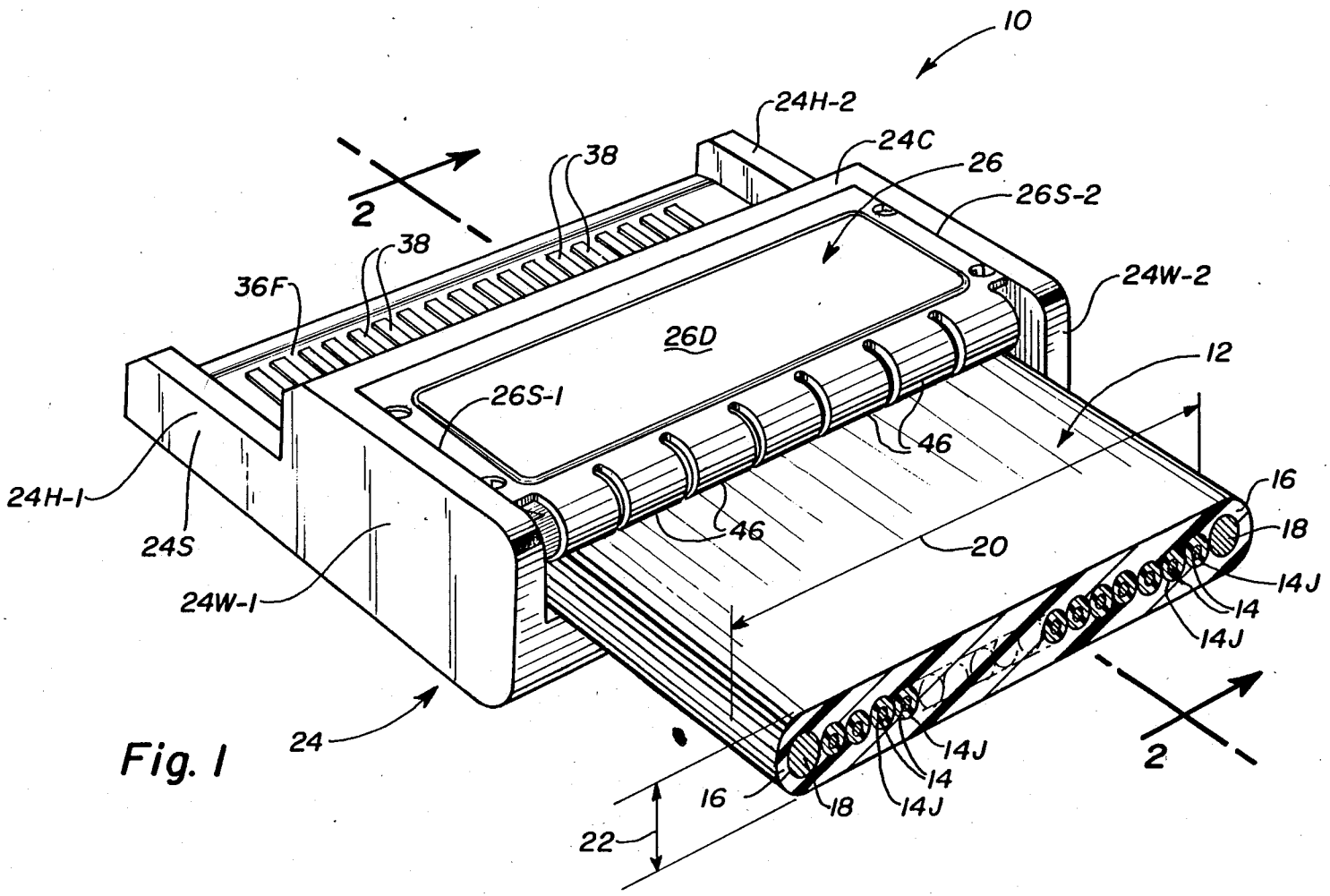
FIG. 1 is a rear perspective view of a connector having a compliant strain relief arrangement in accordance with the present invention.

With reference to FIGS. 1 and 2 shown is a connector generally indicated by reference character 10 for a flat cable 12 of the type having an array of plural conductors 14 therein. The cable 12 is provided with an insulating jacket 16 which surrounds each of the individual electrical conductors. Each conductor 14 is itself provided with a jacket 14J. The cable 12 is provided with at least one, but more preferably two, drain wires 18. The drain wire(s) 18 is (are) typically disposed within the jacket 16 at each lateral end of the array of conductors 14. The outer surface of the insulating jacket 16 imparts to the exterior of the cable 12 a predetermined transverse dimension 20 and a predetermined thickness dimension 22. The cable 12 is typically terminated by the insertion of the same into the connector 10.

The connector 10 includes a housing formed of a lower section, or base, 24 with a corresponding removable cover section 26. The base section 24 includes a generally planar floor 24F having upstanding sidewalls 24W-1 and 24W-2 at each lateral edge of the floor 24F. In the embodiment illustrated the base section 24 has a shelf portion 24S that extends forwardly past the sidewalls 24W. The shelf has reduced height walls 24H-1, 24H-2 (FIG. 1) thereon. A downturned cowling 24C is formed adjacent the front portion of the base 24. The cowling 24C and the floor 24F cooperate to define an aperture 24A (FIG. 2). The base 24 has an upturned lip 24L at the trailing edge thereon. An upstanding platform 24P may be provided across the floor 24F of the base section 24 adjacent the lip 24L thereof.

The cover section 26 is a generally planar member having a leading edge 26L, a trailing edge 26T and generally parallel extending side edges 26S-1 and 26S-2 (FIG. 1). A portion of the cover section 26 is bent along a predetermined bend line 26B-1 (FIG. 2) to define a flap 30. The bend line 26B-1 is disposed adjacent to a generally parallel with the trailing edge 26T of the cover section 26. As will be developed the flap 30 defined on the cover section between the bend line 26B and the trailing edge 26T thereof defines a resilient clamping portion which serves to generate a strain relieving force on the cable 12 when the same is received within a cable receiving volume. In addition a portion of the cover 26 is bent along a second bend line 26B-2 (FIG. 2) generally parallel to the leading edge 26L. This portion of the cover 26 defines a hood portion 26H. A cutout 26C-1 and 26C-2, as seen in FIG. 5, is formed in the hood 26H. The cutouts 26C-1, 26C-2 have a configuration generally analogous to the shape of an insulation displacement tine, for a purpose to be discussed. The central portion of the cover is stiffened by a distention 26D formed therein.

The conjoined base section 24 and cover section 26 cooperate to define a generally rectanguloid cable receiving volume 32 therebetween.

A contact block 36 (FIGS. 2, 8 and 9) fabricated of an insulating material, is mounted to the base 24. The block 36 has a main portion 36M and a forwardly extending finger 36F. The block 36 is received on the base 24 such that the main portion 36M lies within the cable receiving volume 32 while the finger 36F extends through the aperture 24A onto the shell 24S. The main portion of the block 36 has an axially extending groove 36G formed transversely of the block. The groove is interrupted at each axial end thereof by a trough 36T-1, 36T-2. The block 36 has electrical contact elements 38 embedded therein. The contacts 38 project through the material of the block 36 at the rear surface 36R (FIGS. 2 and 8) of the main portion thereof and are disposed in the volume 32 defined on the interior of the connector. It should be understood that this arrangement is merely illustrative and the configuration of the contact block 36 and the arrangement of the contacts 38 thereon may take any alternative form (with the base of the connector conforming). The conductors 14 are suitably affixed to the projecting portion of the contacts 38 by any convenient means of attachment.

As noted earlier, in accordance with the invention the resilient clamping portion is defined by the flap 20 defined on the cover. In the preferred embodiment, as seen in FIGS. 1 to 6, the flap 30 is bent so that the trailing end 26T of the cover extends into the volume 32 and beneath the distended portion 26D of the cover section 26. The bending radius may be sharply acute or gently curved, as desired. However, it should be understood that, as shown in FIG. 7, the flap 30 may be bent so as to lie outside the volume 32 and remain within the contemplation of the present invention. In the most preferred embodiment the flap 30 may be separated into discrete fingers 46. The flap 30, or each finger 46, as the case may be, is provided with lances 48.

When the cover 26 is secured to the base 24, the flap 30 or fingers 46, the sidewalls 24W-1, 24W-2 and the edge of the lip 24L define an opening through which the cable 12 enters into the cable receiving volume 32. The cable is supported on the platform 24P.

With cable 12 introduced into the cable receiving volume 32 and the cover 26 is secured to the base 24 the thickness dimension 22 of the jacket 16 deflects the flap 30 or the fingers 46 from the undeflected position shown in solid lines in FIG. 4 and in dotted lines in FIGS. 6 and 7 (whether the flap or fingers lie within or outside the cable receiving volume, respectively) to the deflected position shown in solid lines in FIGS. 6 and 7. The deformation or deflection of the flap 30 or fingers 46 results in the generation of a reactive clamping force which acts on the cable 12 in a direction 50 (FIG. 2) from the cover 26 toward the base 24. This clamping force clamps the cable 12 between the flap 30 or the fingers 46 and the floor 24F of the base serves to strain relief the cable as the same enters into the cable receiving volume. The lances 48 are urged into the jacket 16 of the cable 12.

It should be appreciated from the foregoing that if the cover 26 is slotted to provide plural fingers 46 each of the fingers acts independently of the others and therefore more efficiently accommodates thickness variations of the cable 12 across the transverse dimension 20 thereof.

When the cable 12 is received within the volume 32 the drain wires 18 are laid into the troughs 36T on the contact block 24. The leading edge 26L of the hood portion 26H of the cover 26 is introduced into the groove 32G such that the material around the cutouts 26C-1, 26C-2 bites into the drain wire(s) 18.

Preferably the base and cover are each made of metal, although such a selection of materials is not necessarily mandated. Any suitable materials for the base and the cover which imparts the necessary structural rigidity and provides the necessary flexibility and resiliency required for the functioning of the device lies within the contemplation of this invention.

The base 24 and the cover 26 may be secured to each other by any suitable means of attachment. For example, the cover 26 may be held to the base by passing screws through openings provided along the lateral edges of the cover 26 and threading the same into one of the sidewalls 24W of the base 24. However, in accordance with the most preferred embodiment of the invention the cover 26 is provided with lateral tabs 26M-1 and 26M-2 which are defined by folding material along lateral fold lines and that are adjacent and parallel to the side edges 26S-1, 26S-2 such that the tabs 26M-1, 26M-2 extend generally perpendicularly to the main portion of the cover 26. The tabs 26M-1, 26M-2 are each provided with a latch opening 26G-1 and 26G-2, respectively. The openings 26G-1, 26G-2 are arranged to engage a corresponding boss 24B-1 (FIG. 2), 24B-2 disposed in a complimentary position on the sidewalls 24W. The preferred implementation is to dispose the boss 24B-1 (only one of which is visible in the Figures) on the interior surface of each of the sidewalls 24W of the base and provide correspondingly positioned latch openings 26G-1, 26G-2 in the tabs 26M-2, 26M-2 provided in the cover. Of course, the bosses may be provided, if desired, on the exterior of the sidewalls 24W of the base and the tabs arranged to overlap the exterior sidewalls of the base. Any alternate latching arrangement may be used.

From the foregoing it may be readily appreciated that the connector in accordance with the present invention provides a clamping arrangement which is readily adaptable to provide a strain relief for cables having thickness dimensions 22 which vary over a substantially wide range. Moreover, when in accordance with the preferred embodiment, when plural fingers are defined adjacent the trailing edge of the cover local variations in the thickness of the cable along the transverse dimension thereof may be readily accommodated.

Those skilled in the art having the benefit of the teachings of the present invention may impart numerous modifications thereto. It should be understood, however, that such modifications are to be construed as lying within the contemplation as defined by the present claims.

What is claimed is:

1. A connector for a flat cable comprising:

a base having a floor and first and second sidewalls;

a cover having a leading edge and a trailing edge, a flap disposed adjacent the trailing edge of the cover, the base and cover, when conjoined, defining a cable receiving volume therebetween, the flap being bent with respect to the cover so that the flap lies outside of the cable receiving volume, the flap being resiliently deflectable by a cable as the same is received within the cable receiving volume to impose a clamping force on the cable which clamps the same between the cover and the base.

2. The cable connector of claim 5 wherein the flap is slotted to define a plurality of sideby-side fingers.

3. The cable connector of claim 2 further comprising means for securing the cover to the base.

4. The cable connector of claim 9 wherein the securing means comprises a projecting boss on the one of the cover or the base and a corresponding opening on the other of the cover or base.

5. The cable connector of claim 1 further comprising means for securing the cover to the base.

6. The cable connector of claim 7 wherein the securing means comprises a projecting boss on the one of the cover or the base and a corresponding opening on the other of the cover or base.

7. The cable connector of claim 2 wherein the cable has a drain wire therein, the connector further comprising: a contact block mounted within the volume, the block having a groove interrupted by a trough; the trough being sized to accept the drain wire; the cover having a hood portion with a cutout therein, the hood having an edge thereon; when the cover is conjoined to the base the edge of the hood being received in the groove so that the drain extends into the cutout therein to contact against the hood.

8. The cable connector of claim 1 wherein the cable has a drain wire therein, the connector further comprising: a contact block mounted within the volume, the block having a groove interrupted by a trough; the trough being sized to accept the drain wire; the cover having a hood portion with a cutout therein, the hood having an edge thereon; when the cover is conjoined to the base the edge of the hood being received in the groove so that the drain extends into the cutout therein to contact against the hood.

* * * * *